United States Patent [19]

Harbauer et al.

[11] 4,140,411

[45] Feb. 20, 1979

[54] PREASSEMBLED BALL-TYPE DISPENSING PACKAGE

[75] Inventors: Paul W. Harbauer, Perrysburg; Richard D. Lohrman; George V. Mumford, both of Toledo, all of Ohio

[73] Assignee: Owens-Illinois, Inc., Toledo, Ohio

[21] Appl. No.: 838,287

[22] Filed: Sep. 30, 1977

[51] Int. Cl.[2] ..... B05C 17/02

[52] U.S. Cl. ..... 401/213; 29/453; 401/216

[58] Field of Search ..... 401/208–220; 29/453

[56] References Cited

U.S. PATENT DOCUMENTS

| | | | |
|---|---|---|---|
| 2,700,784 | 2/1955 | DeBrock | 401/213 |
| 2,975,466 | 3/1961 | Fillmore | 401/213 |
| 2,976,561 | 3/1961 | Culver | 401/213 |

*Primary Examiner*—Clyde I. Coughenour

*Attorney, Agent, or Firm*—John R. Nelson; Myron E. Click; David H. Wilson

[57] ABSTRACT

An improved, preassembled ball-type dispensing package combination for cosmetics and the like. A ball is held in place in a fitment which is adapted to be attached to the finish portion of a container for the product to be dispensed. The ball is allowed to move freely within the fitment to facilitate uniform dispensing and application of the contents of the container. The total package is completed by a closure which engages threads on the exterior of the finish portion of the container. The fitment and closure include engaging portions which are adapted to retain the fitment in a preassembled position within the closure for shipping and handling. However, when the combination closure, fitment and ball are placed in engagement with the container finish portion, the retentive engagement between the fitment and the closure may be overcome to allow the fitment and ball to remain on the container when the closure is removed.

1 Claim, 3 Drawing Figures

PREASSEMBLED BALL-TYPE DISPENSING PACKAGE

BACKGROUND OF THE INVENTION

This invention generally relates to ball-type applicators. More specifically, this invention relates to a complete ball-type applicator package, including a closure, a fitment, a ball and a container for the product to be dispensed. Particularly, this invention relates to an improved package, wherein the fitment and closure include mating portions which retain the fitment and ball within the closure in a preassembled condition for shipping and handling prior to application of these components to the container.

The ball-type applicator is well known in the art for dispensing of cosmetics of various types, particularly liquid deodorants and perfumes. Examples of pertinent prior art patents include U.S. Pat. Nos. 2,975,466 and 4,002,411. Each of these patents teaches the general combination of a closure, fitment and ball as applied to the finish portion of a container neck. However, in each of these patents, the fitment and ball are secured to the container neck prior to the application of the closure. Thus, the fitment and ball are handled separately from the closure during shipping and assembly to the container. Ball-type applicator packages, such as those disclosed in these patents, require rather difficult and costly handling, shipping and assembly procedures due to the number of separate pieces. For example, the ball is first inserted into the fitment, the fitment is then snapped into engagement with the container, and the closure is then threaded into engagement with the container. Each of these steps requires separate items of assembly equipment.

SUMMARY OF THE INVENTION

It is therefore an object of this invention to overcome the disadvantages associated with the prior art ball-type dispensing packages by providing an improved package of this type.

The improved package of this invention incorporates engaging portions on both the fitment and the closure which are adapted to retain the fitment in preassembled position within the closure for shipping and handling. Thus, a ball, which is held within the fitment, and the fitment may be preassembled within the closure to be shipped as a single unit. This combination may then be applied as a single unit to the container neck, at which time the fitment is adapted to engage the container neck to secure the fitment and ball in engagement with the container. The engagement force between the fitment and the container neck is greater than that between the fitment and the closure, so that the closure may be removed from and reapplied to the container without dislodging the fitment or ball from assembly with the container.

Other objects, features and advantages of this invention will become apparent upon reference to the following detailed description of the invention and the drawings illustrating a preferred embodiment thereof.

IN THE DRAWINGS

DETAILED DESCRIPTION OF A PREFERRED EMBODIMENT

Figure 1:
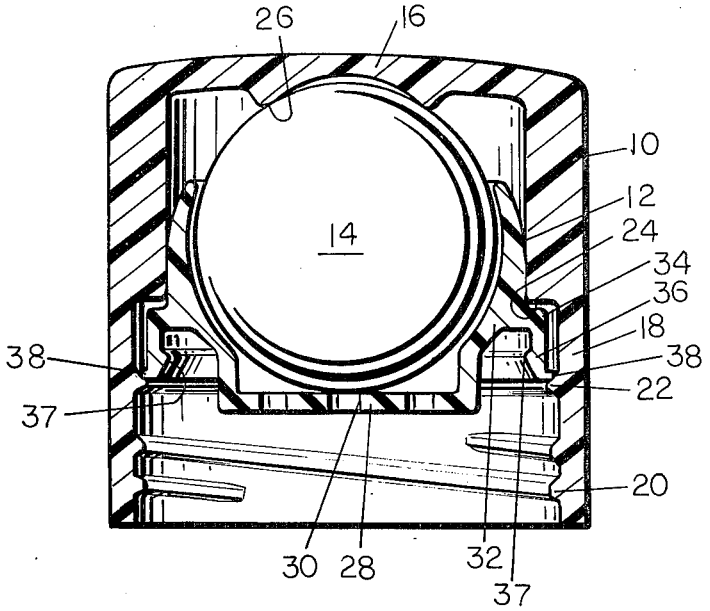
FIG. 1 is a cross sectional, side elevation view of the unique fitment, ball and closure combination of the present invention in its preassembled configuration.

As can be seen in FIG. 1, the combination package of this invention includes a closure 10, a fitment 12, and a ball 14. The closure 10 includes a circular top panel 16 and an annular skirt 18 depending downwardly from the outer periphery of the top panel 16. The interior portion of the closure skirt 18 includes a plurality of threads 20 located near the lower extremity thereof and an enlarged fitment-retaining bead 22. The interior of the closure skirt 18 also includes a fitment-contacting annular shoulder 24. The interior surface of the top panel 16 of the closure 10 includes an annular ball-contacting ring 26 which is adapted to contact the upper surface of the ball 14 upon application of the closure 10 to a container.

The fitment 12 includes a generally circular bottom panel or diaphragm 28 which incorporates one or more product-dispensing apertures 30 therein. An annular ball-retaining socket 32 extends upwardly from the bottom diaphragm 28 in an arcuate configuration. The fitment 12 further incorporates an annular shoulder portion 34 extending outwardly from said ball-retaining socket 32 and which is adapted to be engaged by the shoulder portion 24 on the closure 10. This engagement between shoulders 24 and 34 aids in positioning the fitment and ball within the closure. An annular container-engaging skirt 36 extends downwardly from the shoulder 34 and is spaced radially outwardly from the diaphragm 28. The fitment 12 is sized and shaped so that the ball 14 is held within the ball-retaining socket 32 and rests against the bottom diaphragm 28. However, the ball 14 must be permitted to rotate freely within the fitment 12 and must have a minor portion extending beyond the fitment for application purposes. The lower extremity of the downwardly extending skirt 36 on the fitment 12 includes an inwardly directed annular bead 37 and an outwardly directed flange 38, which is adapted to cooperate with the fitment-retaining bead 22 on the closure 10 to hold the fitment 12 within the closure 10. It should be noted that the fitment-retaining bead 22 on the closure 10 may be an extension of the threads 20 which would cooperate with the flange 38. Thus, to assemble the components of FIG. 1, the ball 14 is positioned within the fitment 12, and this combination is then inserted within the closure 10 to the position where the flange bead 38 on the skirt 36 resides between the fitment retaining bead 22 and the shoulder 24 on the closure skirt 18. Therefore, for shipping, handling and assembly to a container, these three components may be handled as a single, preassembled unit.

Figure 2:
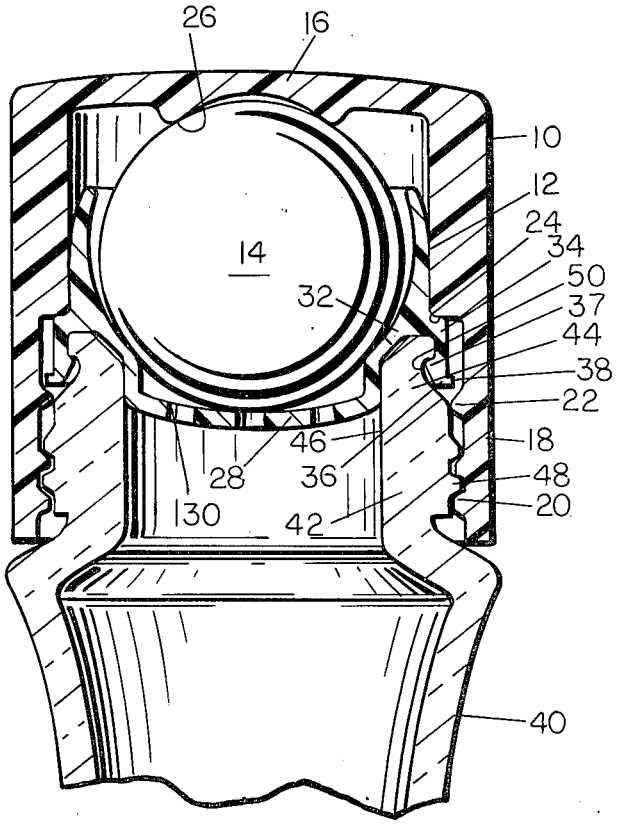
FIG. 2 is a cross sectional, side elevation view of the complete dispensing package of this invention as applied to the neck portion of a container.
Figure 3:
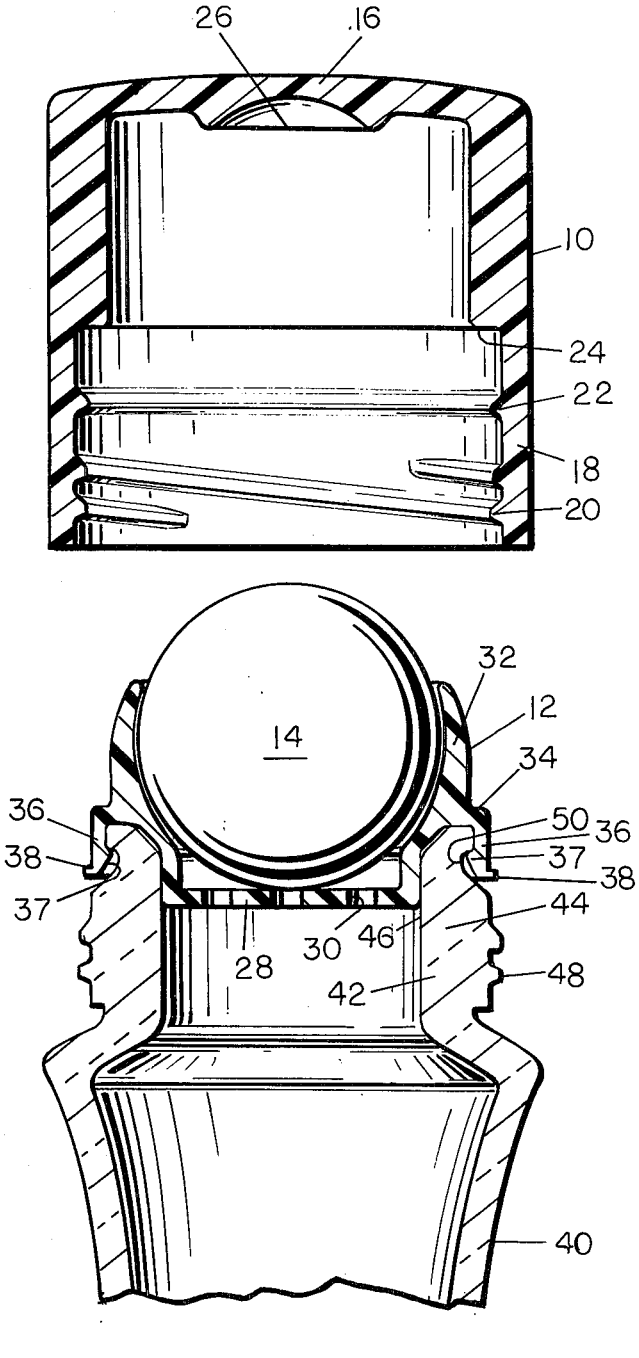
FIG. 3 is a cross sectional, side elevation view of the package of this invention, showing the closure removed from engagement with the finish portion of the container neck.

FIG. 2 shows the package components of FIG. 1 as they are assembled to a container, which is indicated generally by the numeral 40. The container 40 terminates at its upper extremity in an annular neck 42, which includes a finish portion 44 which defines the periphery of an open mouth 46 through which the contents of the container 40 may be dispensed. The outer surface of the container neck finish 44 includes one or more threads 48 which are adapted to matingly engage the threads 20 on the closure 10. An annular recess 50 is also formed on the outer surface of the container neck finish 44 to receive the inwardly directed annular bead 37 on the downwardly extending skirt 36 on the fitment 12. Thus, when the combination of the elements of FIG. 1 is assembled into engagement with the container 40, the closure 10 is rotated downwardly into threaded engagement with the finish portion 44 of the container neck 42. Simultaneously, the downwardly extending skirt 36 of fitment 12 snaps over the upper portion of the finish 44, so that its inwardly directed annular bead 37 resides within the annular recess 50. The engagement between this annular skirt 34 and the container neck is sufficiently strong such that when it is desired to remove the closure from the container, the fitment retaining bead 22 on the closure 10 will slide over the outwardly directed flange 38 on the fitment 12 without dislodging the fitment from engagement with the container neck. The removal of the closure 10 can be seen in FIG. 3. Once the closure has been removed, the package is in condition for dispensing of the product from the container. The product may then pass from the container 40 through the apertures 30 in the fitment 12 into contact with the lower surface of the ball 14. As the ball 14 is rotated within the fitment 12, the product which has been picked up by the ball 14 may then be applied to the surface desired, such as the skin of the user. It should be noted further that the engagement of the shoulders 24 and 34 on the closure and fitment, respectively, prevents over-tightening of the closure and potential damage to the ball. It should be noted that the diaphragm 28 is in an unstressed position in FIGS. 1 and 3, but is flexed slightly in FIG. 2 as the closure is threaded into engagement with the container. In the FIG. 2 position, a seal is created between the ball and the ball-retaining socket.

It should be seen then, that through the use of retaining projections on the closure and fitment, this invention provides a ball-type applicator package wherein preassembly of the closure fitment and ball is facilitated for easier handling, shipping and assembly. However, the package of this invention incorporates adequate retention means between the fitment and the container neck such that the engagement between the fitment and the closure may be overcome when it is desired to remove and reapply the closure portion of the package.

We claim:

1. An improved pre-assembled ball applicator dispensing package comprising, in combination:

a container having a neck portion defining an opening at one end thereof for dispensing the contents thereof, said neck portion including at least one external thread and a circumferential groove formed above said thread;

an annular ball-retaining fitment of a resilient material having a generally circular bottom diaphragm fitting within the opening of said container neck and including at least one aperture for dispensing the contents of said container, an annular ball-retaining socket extending upwardly from said bottom diaphragm in an arcuate configuration, an annular shoulder extending outwardly from said ball-retaining socket, and an annular container-engaging skirt extending downwardly from said shoulder spaced radially outwardly from said bottom diaphragm, said container-engaging skirt including an inwardly directed bead for engagement with said circumferential groove on said container neck and an outwardly directed flange;

a dispensing ball having a major portion inserted within said annular ball-retaining socket of said fitment so as to be in communication with said dispensing aperture and having a minor portion extending beyond the extremity of said annular ball-retaining socket to define a dispensing surface; and a closure member having at least one internal thread for engagement with the thread on the neck of the container, said closure member including an inwardly directed annular fitment-retaining bead adapted to engage the outwardly directed flange on said container-engaging annular skirt of the fitment to retain said fitment and ball within the closure prior to assembly with said container, and the engagement between the inwardly directed annular bead on the fitment and the circumferential groove on the container neck being sufficient to overcome the engagement between the annular fitment-retaining bead on the closure and the outwardly directed flange on the fitment to thereby allow removal of the closure from threaded engagement with said container neck while said fitment remains in engagement with the container neck.

* * * * *